US007757456B2

(12) United States Patent
Fontecchio

(10) Patent No.: US 7,757,456 B2
(45) Date of Patent: Jul. 20, 2010

(54) MONOLITHIC ABRASIVE SNOW RETENTION SYSTEM

(75) Inventor: Wesley Fontecchio, Iron Mountain, MI (US)

(73) Assignee: Top of the Line Unlimited, LLC, Iron Mountain, MI (US)

( * ) Notice: Subject to any disclaimer, the term of this patent is extended or adjusted under 35 U.S.C. 154(b) by 829 days.

(21) Appl. No.: 11/598,468

(22) Filed: Nov. 13, 2006

(65) Prior Publication Data

US 2008/0110103 A1 May 15, 2008

(51) Int. Cl.
*E04B 1/00* (2006.01)
*E04G 21/00* (2006.01)
*E04G 23/00* (2006.01)

(52) U.S. Cl. ..... 52/746.11; 52/517; 52/411; 52/741.3

(58) Field of Classification Search ..... 52/309.4, 52/408, 411, 515, 741.3, 741.4, 746.11, 517, 52/90.1
See application file for complete search history.

(56) References Cited

U.S. PATENT DOCUMENTS 2,201,320 A 5/1940 Place
3,971,184 A * 7/1976 Van Wagoner ..... 428/201
4,021,981 A * 5/1977 Van Wagoner ..... 52/309.13
4,614,755 A 9/1986 Rodgers
4,708,978 A 11/1987 Rodgers
5,171,818 A 12/1992 Wilson
5,246,650 A * 9/1993 Clark ..... 264/87
5,328,096 A * 7/1994 Stenge et al. ..... 239/123
5,900,061 A 5/1999 Wright
5,979,133 A * 11/1999 Funkhouser ..... 52/408
5,985,366 A * 11/1999 Wright ..... 427/340
6,141,917 A 11/2000 Mueller
6,385,934 B1 5/2002 Zickell et al.
6,632,860 B1 10/2003 Hansen et al.
6,688,047 B1 2/2004 McNichol
6,783,799 B1 * 8/2004 Goodson ..... 427/140
7,168,221 B2 * 1/2007 Hunter, Jr. ..... 52/746.11

FOREIGN PATENT DOCUMENTS

JP 10280623 10/1998
JP 11226491 8/1999

* cited by examiner

*Primary Examiner*—Richard E Chilcot, Jr.
*Assistant Examiner*—Chi Q Nguyen
(74) *Attorney, Agent, or Firm*—Michael I. Kroll

(57) ABSTRACT

A coating system for a roof for the retention of snow and ice thereon. The coating system employs a base layer, which is applied to the roof surface. The base layer may provide a liquid impermeable barrier layer on the roof surface. An aggregate is spread or broadcast over the base layer while the base layer is in a liquid state. The base layer and the aggregate are secured to the roof surface once the base layer has cured. The aggregate protrudes from the upper surface of the base layer to provide maximum snow and ice retention.

43 Claims, 18 Drawing Sheets

| LIQUID APPLIED COATING MATERIAL | |
|---|---|
| MFR / TRADE NAME | COMPOSITION |
| TOPPS SEAL EXCEL SYSTEM 1000 | LIQUID RUBBER |
| EPDM / LIQUID RUBBER | LIQUID RUBBER |
| UNIFLEX | ACRYLIC |
| UNITED COATINGS ROOF MATE | ACRYLIC |
| AMERICAN WEATHERSTAR ACRYLIC 210 | ACRYLIC |
| EVEREST COATINGS EC5400/5410 | ACRYLIC |
| EVEREST COATINGS EVERCOAT 900 SERIES | POLYURETHANE FOAM |
| OTHER | LIQUID RUBBER |
| OTHER | ACRYLIC |
| OTHER | POLYURETHANE FOAM |
| OTHER | PVC |
| OTHER | LATEX |

FIG. 16

MONOLITHIC ABRASIVE SNOW RETENTION SYSTEM

BACKGROUND OF THE INVENTION

1. Field of the Invention

The present invention relates generally to abrasive coating systems and, more specifically, to a monolithic abrasive snow retention system for roof tops and other smooth surface areas.

Model building construction codes require all roofs to have a minimum slope of ¼" per foot to keep water from ponding on the roof structure. Even this minimal slope will cause sliding snow to discharge from a roof. Yet the timing and magnitude of such discharge is unpredictable. The unpredictable and sudden discharge falls on people and property without warning and has caused injury, death and millions of dollars of property damage.

Currently, the model building construction codes include little or no requirements to prevent sliding snow or impose measures to prevent such personal injury or property damage in the discharge zones adjacent to buildings.

The present invention overcomes this problem by providing a snow grip system that will prevent snow and ice from sliding off metal and other smooth surface roofs. This process will serve to dramatically reduce personal injury and property damage by the uncontrolled discharge of a roof snow/ice pack.

This invention is a system that creates a highly abrasive roof surface that prevents snow and ice from sliding off of smooth surface roofs and consists of a uniformly distributed aggregate matrix set in a cured liquid membrane that coats and bonds to the entire surface of a smooth roof where sliding snow is intended to be prevented.

Although the primary applications for the monolithic abrasive snow retention system is for metal roofing, smooth surface shingle roofing, and smooth surface membrane roofing, other possible uses and/or applications can benefit from the system. Such application include, applying the abrasive system to walkways, catwalks, scaffolding planks, ladders, or other work platforms. Additionally, the abrasive system can be applied onto soles of footwear to improve footing on ice or other slippery surfaces.

The application process for the monolithic snow retention system includes the following steps.

1) Clean roof surface of debris according to ASTM C 1127 and site written specifications 2) Dry roof surface 3) Apply a uniform distribution of liquid base coat on roof surface at designated rate *(1-2 gal. Per 100 sq. Ft)

* Note: designated rate for distribution of liquid base coat and the broadcast of the abrasive aggregate may be decreased or increased to suit individual application requirements 4) Uniformly broadcast spread drop abrasive aggregate on roof surface at designated rate *(2-5 lbs per 100 sq. Ft).

5) Allow assembly to cure and set for specified period of time.

To suit individual applications, variables in the application process for the "snow grip" snow retention system include; the means to apply the coating material, the type of coating material (as described within FIG. 16), the volume of coating material per square foot, the type of aggregate material (as described within FIG. 17 and FIG. 18), the density of aggregate material per square foot, and the grit size of the aggregate material.

The snow grip system of the present invention provides improved and/or unique features over existing snow retention systems. Such features include; the application applies and adheres to the surface of the roof material and will not require the roof membrane to be penetrated by fasteners. Therefore the likelihood of voiding roof warrantees because of fastener penetration and the promotion of roof leaks at fastener penetration does not exist; the snow grip system is applied uniformly to the entire surface of the roof area that requires snow retention rather than at isolated spot locations; the snow grip system keeps the snow/ice pack from ever starting significant movement; the snow grip system will significantly reduce the reliance on costly project-by-project engineering evaluations; the snow grip system may be used to change or rejuvenate the color of the existing roof top; the snow grip system improves insulation value in winter by retaining snow pack which will act as an additional layer of insulation over the entire roof and the snow grip system can add to the service life of a roof unlike "mechanical type" snow retention systems that are likely to shorten the life of a roof.

2. Description of the Prior Art

There are other coating systems designed for roofs. Typical of these is U.S. Pat. No. 2,201,320 issued to Place on May 21, 1940.

Another patent was issued to Rodgers on Sep. 30, 1986 as U.S. Pat. No. 4,614,755. Yet another U.S. Pat. No. 4,708,978 was issued to Rodgers on Nov. 24, 1987 and still yet another was issued on Dec. 15, 1992 to Wilson as U.S. Pat. No. 5,171,818.

Another patent was issued to Wright on May 4, 1999 as U.S. Pat. No. 5,900,061. Yet another U.S. Pat. No. 5,985,366 was issued to Wright on Nov. 16, 1999. Another was issued to Mueller on Nov. 7, 2000 as U.S. Pat. No. 6,141,917 and still yet another was issued on May 14, 2002 to Zickell as U.S. Pat. No. 6,385,934.

Another patent was issued to Hanson, et al. on Oct. 14, 2003 as U.S. Pat. No. 6,632,860. Yet another patent was issued to McNichol on Feb. 10, 2004 as U.S. Pat. No. 6,688,047.

Internationally, a Japanese patent was issued to Seiichi on Oct. 20, 1998 as Japan Patent No. JP10280623. Another Japanese Patent No. JP11226491 was issued on Aug. 24, 1999 to Atsushi.

U.S. Pat. No. 2,201,320

Inventor: Bion C. Place

Issued: May 21, 1940

The present invention relates to snow guards designed for ready application to a roof structure to prevent accumulated snow and ice from sliding from the roof in large masses. More particularly, the invention is concerned with a sheet metal snow guard, particularly adopted for ready application to a metal roof having standing seams.

U.S. Pat. No. 4,614,755

Inventor: Jack L. Rodgers

Issued: Sep. 30, 1986

There is disclosed a protective, waterproof coating composition suitable for application to surfaces of concrete, wood or metal to provide each surface with increased abrasion and chemical resistance. The composition comprises a blend of hydraulic cement in the range of 5 to 18 wt. %, 200 mesh limestone in the range of 20 to 50 wt. %, 0.5 to 6.0 wt. % polyvinyl acetate, the balance of the blend 50 mesh limestone, the blend having admixed therewith a solution comprised to 30 to 60 wt. % of a vinyl acetate-ethyl copolymer emulsion, the remainder water.

U.S. Pat. No. 4,708,978

Inventor: Jack L. Rodgers

Issued: Nov. 24, 1987

There is disclosed a protective coating composition suitable for application to surfaces of concrete, wood or metal to provide each surface with increased skid and chemical resistance. The composition comprises a blend of hydraulic cement in the range of 5 to 18 wt., 0.5 to 6.0 wt. % polyvinyl acetate, the balance silica sand, the blend having admixed therewith a solution comprised 10 to 70 wt. % of a vinyl acetate-ethylene copolymer, the remainder water.

U.S. Pat. No. 5,171,818

Inventor: E. Lynn Wilson

Issued: Dec. 15, 1992

Sprayable aliphatic polyurea-polyurethane coating compositions and methods are disclosed. A quasi-prepolymer composition is prepared by mixing an aliphatic polyisocyanate with a stoichiometrically deficient quantity of polyol such that substantially all of the available hydroxyl groups of the polyol react with the isocyanate groups of the aliphatic polyisocyanate. Suitable catalysts may be used to accelerate the urethane bonding in the quasi-prepolymer composition. The polymeric coating is preferably formed by reacting the quasi-prepolymer composition with a low molecular weight or a mixture of low and high molecular weight amine terminated polyether compounds. The amine terminated polyether compounds have amine groups capable of reacting with the unreacted isocyanate groups of the quasi-prepolymer Mixing of the quasi-prepolymer composition and the amine terminated polyether is preferably done at a sufficiently fast rate of result in a substantially homogeneous product. The currently preferred method of mixing is impingement mixing. The resulting mixture preferably has a sufficiently slow cure time such that the mixture is capable of being sprayed, but has a sufficiently fast cure time such that the mixture may be sprayed uniformly on non-horizontal surfaces.

U.S. Pat. No. 5,900,061

Inventor: Winfield S. Wright

Issued: May 4, 1999

Improved sprayable roof coating systems which provide immediate waterproofing of a newly-sprayed latex-based ionic roof coating by applying to the upper surface of such roof coating an ionic catalyst having a pH opposed to the pH of such roof coating, whereby such upper surface of such roof coating coagulates immediately to form a thin waterproof surface layer on such roof coating and the bottom portions of such roof coating are permitted to coagulate and bond to the underlying roof normally. Also, latex-based sprayable roof coating systems permitting use in roof mastics of recycled rubber and spray equipment for such systems which do not clog up when air spraying such recycled-rubber-containing roof mastics.

U.S. Pat. No. 5,985,366

Inventor: Winfield S. Wright

Issued: Nov. 16, 1999

Improved sprayable roof coating systems which provide immediate waterproofing of a newly-sprayed latex-based ionic roof coating by applying to the upper surface of such roof coating an ionic catalyst having a pH opposed to the pH of such roof coating, whereby such upper surface of such roof coating coagulates immediately to form a thin waterproof surface layer on such roof coating and the bottom portions of such roof coating are permitted to coagulate and bond to the underlying roof normally. Also, latex-based sprayable roof coating systems permitting use in roof mastics of recycled rubber and spray equipment for such systems which do not clog up when air spraying such recycled-rubber-containing roof mastics.

U.S. Pat. No. 6,141,917

Inventor: George B. Mueller

Issued: Nov. 7, 2000

A roof panel construction includes a plurality of integral snow and ice gripping projections to help retain accumulated ice thereon and to guide the drainage of melted snow and ice therefrom during snow and ice melting ambient conditions. The projections are each convex in configuration to grip the frozen snow and ice and yet permit efficient drainage of the melted snow and ice thereover and therearound.

U.S. Pat. No. 6,385,934

Inventor: Thomas J. Zickell, et al.

Issued: May 14, 2002

A weatherproofing membrane having a high traction surface is used on a roof or other such location to prevent individuals from slipping. The weatherproofing membrane includes a facer sheet formed of a weatherproofing material and one or more polymer regions disposed on an upper side of the facer sheet. The weatherproofing membrane also includes a layer of modified asphalt disposed on the lower side of the facer sheet and a release backing disposed over the modified asphalt. The polymer is softer than the weatherproofing material and thus provides a higher traction surface than the weatherproofing material of the facer sheet. The polymer includes a low molecular weight polyethylene and an amorphous polyolefin (APO) in respective proportions ranging from about 50/50 to 90/10. The low molecular weight polyethylene and the APO are mixed hot and applied to the facer sheet, for example, using conventional coating techniques.

U.S. Pat. No. 6,632,860

Inventor: George P. Hansen, et al.

Issued: Oct. 14, 2003

A process for coating a solid surface comprises 1) applying onto a solid surface a primer coating prepared from an amine curing agent, a polysulfide toughening agent, an epoxy resin, a rubber toughening agent, a fire retardant, a glass fiber thixotrope, and a pigment; and 2) applying onto the primer coating a topcoat prepared from an amine curing agent, a polysulfide toughening agent, an epoxy resin, a rubber toughening agent, a fire retardant, a glass fiber thixotrope, a pigment and an abrasive aggregate.

U.S. Pat. No. 6,688,047

Inventor: John Joseph McNichol

Issued: Feb. 10, 2004

An apparatus for retaining and controlling the size of pieces of snow and/or ice accumulating on a roof contains brackets secured to the roof and rails passed between the brackets to form a frame structure. The brackets have slots and/or pockets for fitting rails and enable the rails to be at or below the level of seams on seamed roofs and at a low profile with non-seamed roofs. In addition, the brackets may be attached to the roof without penetrating the roof structure. A method of installing a snow and/or ice retaining apparatus includes lowering the rails into pockets on the brackets, sliding the rails into slots on the brackets, and, optionally, securing the rails with a clip, wedge, or adhesive.

Japanese Patent Number JP10280623

Inventor: Amano Seiichi, et al.

Issued: Oct. 20, 1998

PROBLEM TO BE SOLVED: To provide an antiskid property without degrading a waterproofing property physical strength, a nail hole water stopping property and moisture permeability by applying a resin to one side of nonwoven fabric for forming a plurality of spot type resin projections and filament type projections. SOLUTION: A resin is applied to at least one side of nonwoven fabric made by the flash spinning method using polyolefine resin, thereby providing a plurality of spot type resin projections 4 and 4 formed like scattering and made independent of each other. In this case, a plurality of rows of filament type projections 5 and 5 are preferably formed approximately in parallel with the end of the nonwoven fabric. More preferably, the resin is applied to a side different from a side having the projections 4 and 5, thereby forming a plurality of filament type projections 5 approximately in parallel with the end of the nonwoven fabric. Thus, a high antiskid property is provided without degrading a high waterproofing property, physical strength, a nail hole water stopping property and humidity permeability.

Japanese Patent Number JP11226491

Inventor: Nakagawa Atsushi

Issued: Aug. 24, 1999

PROBLEM TO BE SOLVED: To obtain a high antiskid effect by a simple process and to firmly fix a solid granular material to the surface of a coating film by spraying and depositing a solid granular material having a specified average aspect ratio onto a coating film. SOLUTION: A slurry essentially comprising cement and silica sand is formed into a sheet and dehydrated, compressed by pressing, subjected to primary and secondary aging, and cut into a specified shape to produce a raw plate 1 for a flat plate-like roof material. A base coat is applied all over the top and back surfaces of the plate 1, then an intermediate coating is applied and further a coating material is applied to form a coating film 2. Then, a sand 3 as a solid granular material having >=1.2 average aspect ratio is sprayed from the upper part of the coating film 2, and the film is dried and hardened. After drying, a topcoat 4 is applied and dried to obtain a planer roof material. By spraying the sand 3 having >=1.2 aspect ratio from the upper position of the plate, the granules are aligned in the longitudinal direction of the granules as a whole in the dropping process, and the granules drop in this state onto the unhardened coating film 2. By hardening the film as it is, the sand 3 is fixed to the surface of the coating film 2.

While these roof coating systems may be suitable for the purposes for which they were designed, they would not be as suitable for the purposes of the present invention, as hereinafter described.

SUMMARY OF THE PRESENT INVENTION

A primary object of the present invention is to provide a frozen water retention system that prevents snow and ice from sliding off metal and other smooth surfaces.

Another object of the present invention is to provide a frozen water retention system that serves to reduce personal injury and property damage due to uncontrolled discharge of ice and snow.

Yet another object of the present invention is to provide a frozen water retention system that is composed of a liquid base coat that is applied to the roof or other desired surface.

Still yet another object of the present invention is to provide a frozen water retention system that is composed of a liquid base coat that is applied on the surface at various rates of gallons/sq. foot depending on the application and/or specifications.

Another object of the present invention is to provide a frozen water retention system that is composed of an abrasive aggregate that is broadcast on the surface.

Another object of the present invention is to provide a frozen water retention system where the abrasive aggregate is exposed above the surface of the base coat.

Yet another object of the present invention is to provide a frozen water retention system that is composed of an abrasive aggregate that is applied on the surface at various rates of lbs/sq. foot depending on the application and/or specifications.

Still yet another object of the present invention is provide a frozen water retention system that is composed of an abrasive aggregate of various grit size that is applied on the surface depending on the application and/or specifications.

Still yet another object of the present invention is to provide a frozen water retention system that can utilize various natural abrasive materials as the aggregate.

Yet another object of the present invention is to provide a frozen water retention system that can utilize various artificially manufactured abrasive materials as the aggregate.

Additional objects of the present invention will appear as the description proceeds.

The present invention overcomes the shortcomings of the prior art by providing a system with improved and/or unique features over existing snow retention systems. Such features include; a base coating which is applied and adheres to the exposed surface of the roof material and does not require the roof membrane to be penetrated by fasteners. Therefore the likelihood of voiding roof warrantees because of fastener penetration and the promotion of roof leaks at fastener penetration does not exist; the snow grip system is applied uniformly to the entire surface of the roof area that requires snow retention rather than at isolated spot locations; the snow grip system keeps the snow/ice pack from ever starting significant movement; the snow grip system will significantly reduce the reliance on costly project-by-project engineering evaluations; the snow grip system may be used to change or rejuvenate the color of the existing roof top; the snow grip system improves insulation value in winter by retaining snow pack which will act as an additional layer of insulation over the entire roof and the snow grip system can add to the service life of a roof unlike "mechanical type" snow retention systems that are likely to shorten the life of a roof.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 16 is a chart of suitable liquid base coating material for "snow grip" snow retention system of the present invention.

LIST OF REFERENCE NUMERALS

Figure 1:
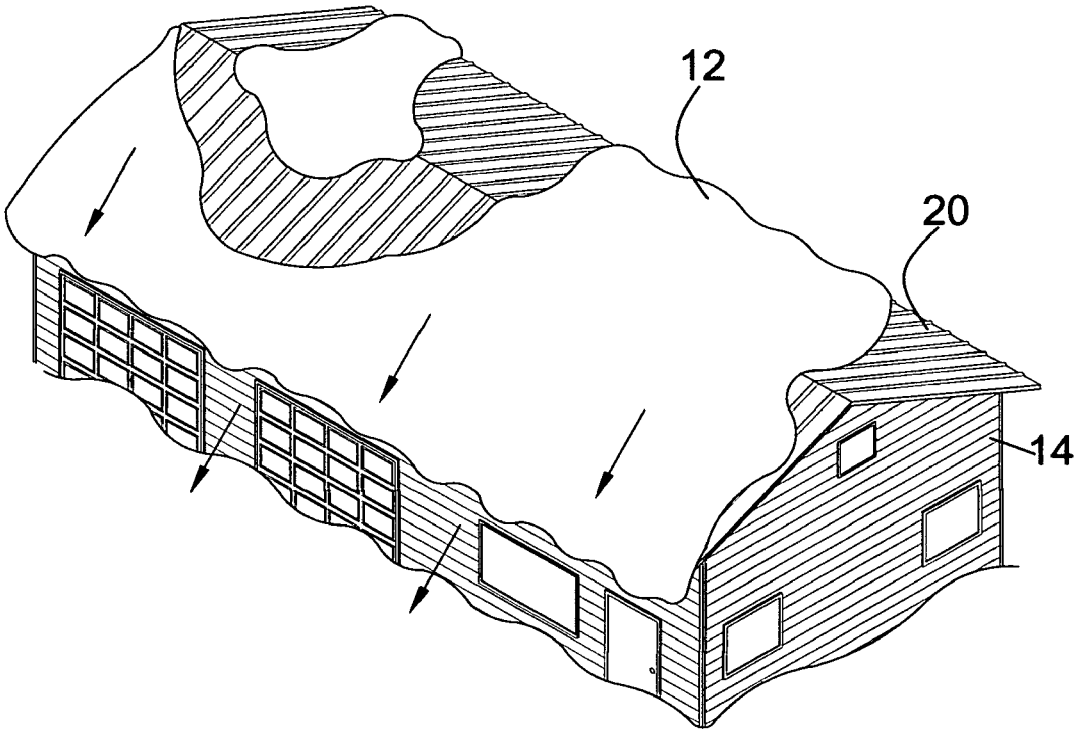
FIG. 1 (PRIOR ART)
FIG. 1 is an illustrative view of prior art.
Figure 2:
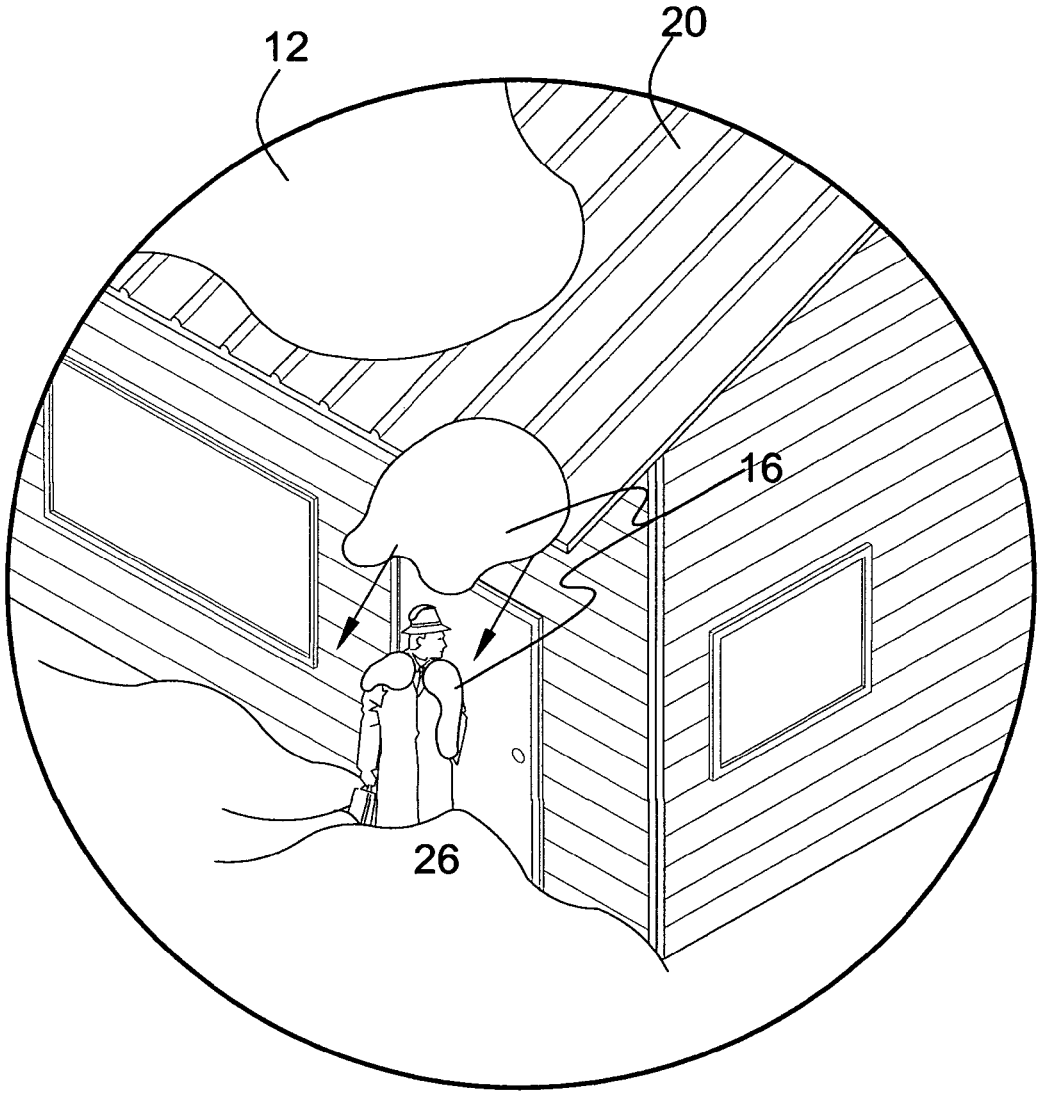
FIG. 2 (PRIOR ART)
FIG. 2 is an illustrative view of prior art.

With regard to reference numerals used, the following numbering is used throughout the drawings.

10 Present Invention
12 Snow
14 Building
16 Snow Discharge
18 Discharge Zone
20 Roof
22 Base Layer
24 Aggregate
26 Personal Injury
28 Blocking Doors and Exits
30 Wall Damage
32 Landscape and Plant Damage
34 Roof Damage
36 Vehicle Damage
38 Broadcast Application
40 Spray Application
42 Air Space
44 Snow Layers
46 Metal Roof
48 Snow Sheet
50 Ice Layer
52 Water Layer
54 Accumulated Snow
56 Melt Water

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 5:
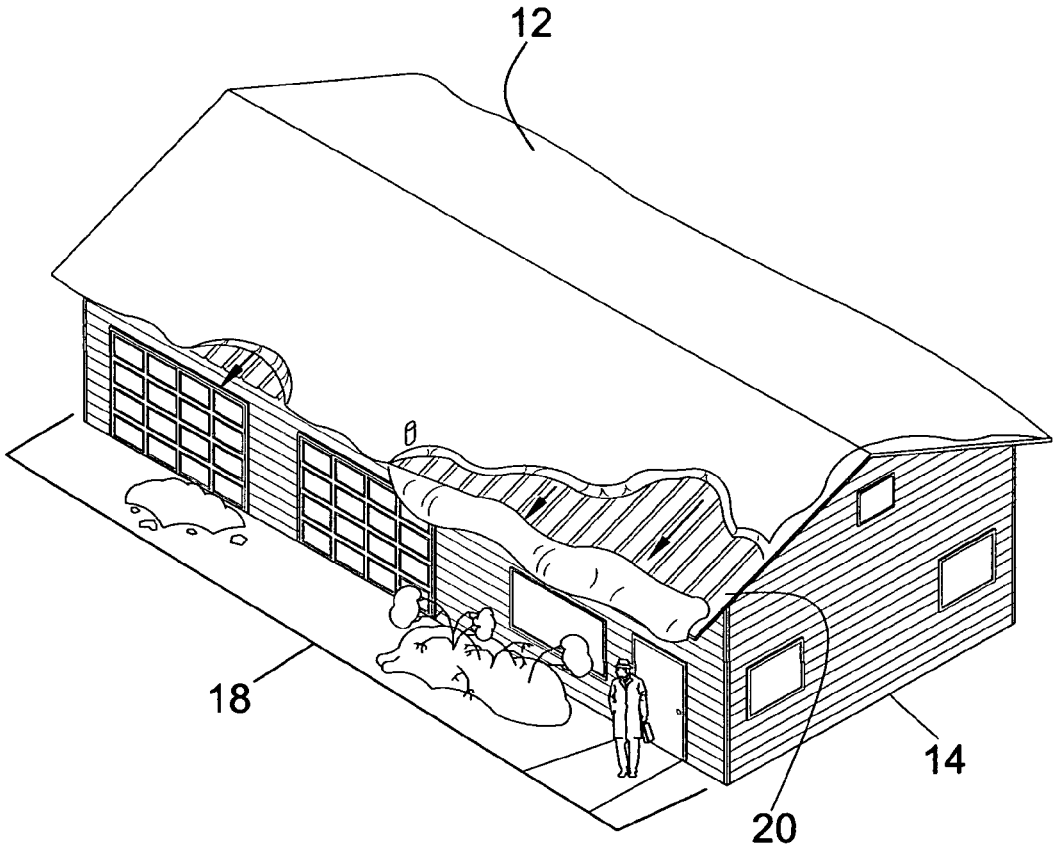
FIG. 5 is a typical view of a metal or smooth surface roof of the present invention.
Figure 6:
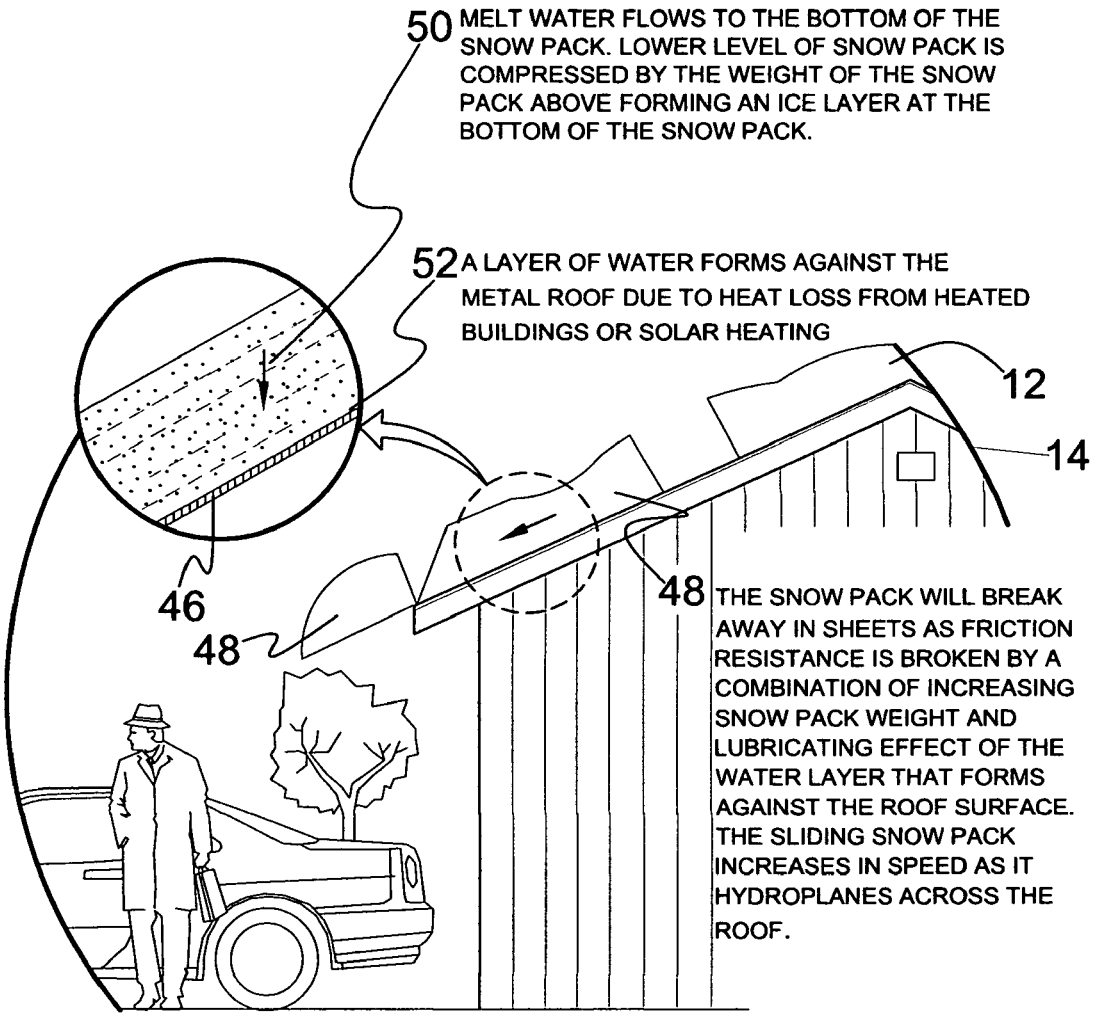
FIG. 6 is an illustrative view of how snow or ice slides off an unprotected roof.
Figure 7:
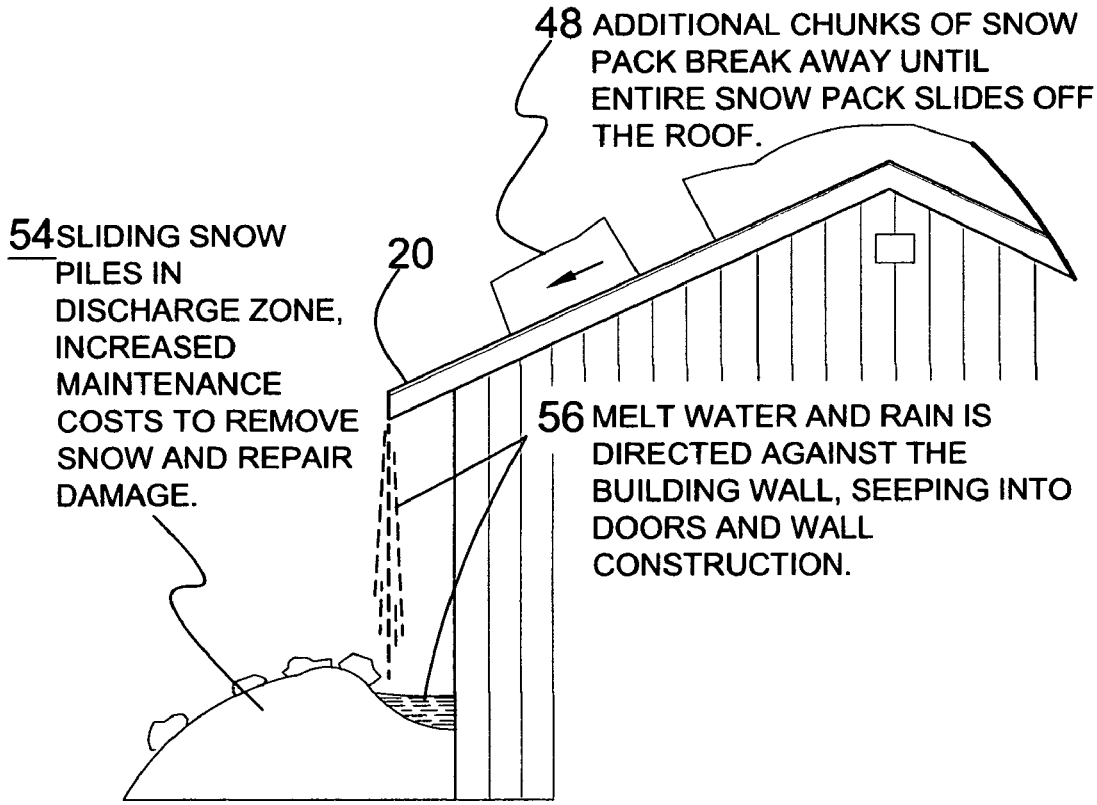
FIG. 7 is an illustrative view of the damage of snow and ices causes after sliding off an unprotected roof.
Figure 8:
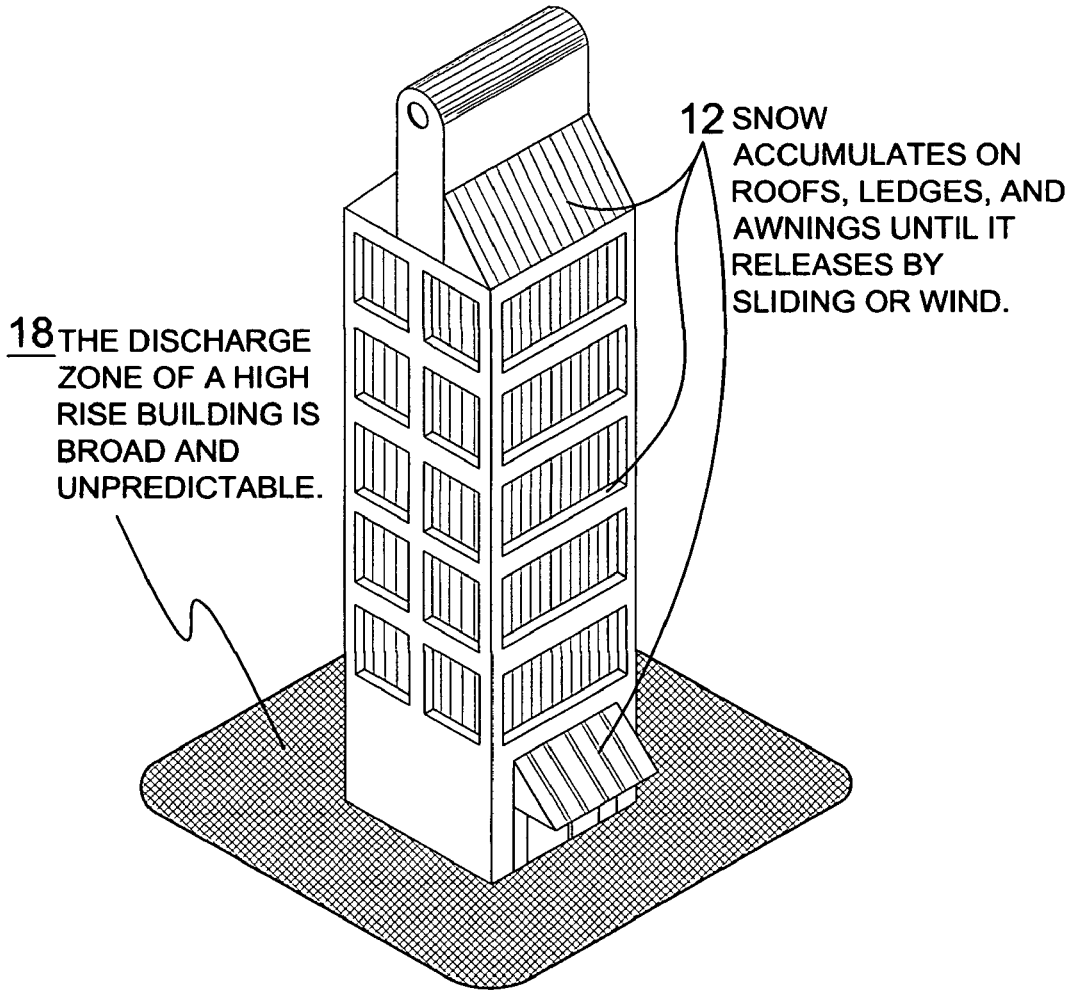
FIG. 8 is a typical view of a metal or smooth surface roof of the present invention.
Figure 14:
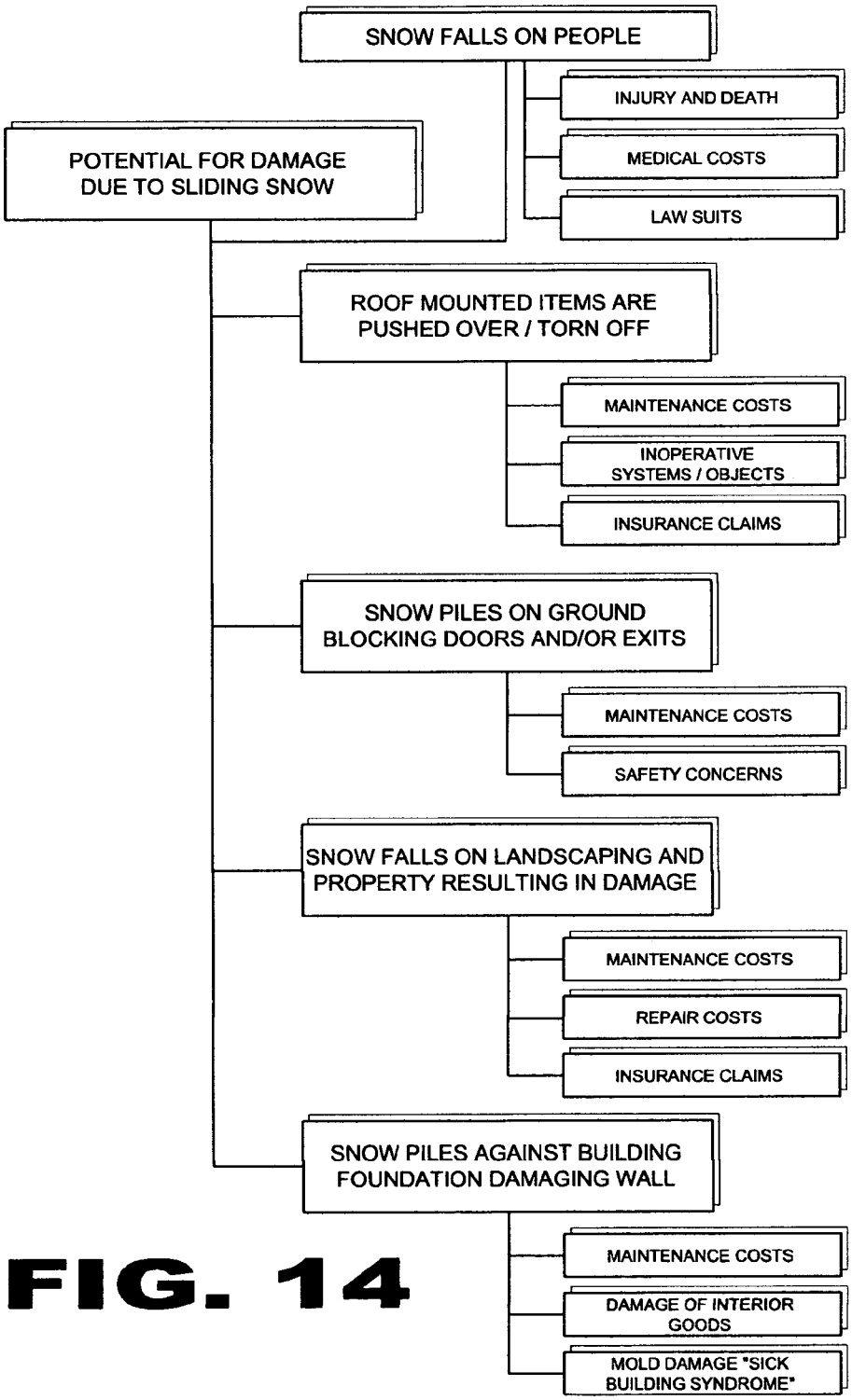
FIG. 14 is a block diagram of potential for damage due to sliding snow.

FIGS. 1 and two are illustrative of prior art. Model building construction codes require all roofs to have a minimum slope of ¼" per foot to keep water from ponding on the roof structure. Even this minimal slope will cause sliding snow to discharge from a roof. Currently, the model building construction codes include little or no requirements to prevent sliding snow or impose measures to prevent personal injury or property damage in the discharge zones adjacent to buildings. The discharge of sliding snow and ice from smooth surface roofs is inevitable even from roofs with very flat profiles. Yet the timing and magnitude of such discharge is unpredictable. The unpredictable and sudden discharge falls on people and property without warning and has caused injury, death and millions of dollars of property damage. The potential damages that are prevented by the snow grip system are noted in block diagram form in FIG. 14. The potential damages are shown in illustrative form in FIGS. 2, 4-7. The damages may include personal injury 26, blocking doors and exits 28, wall damage 30, landscaping and plat damage 32, roof damage 34, and vehicle damage 36. There is potential damage for anything located in the discharge zone. The discharge zone is the area in which the snow or ice will fall once it slides from the roof. The discharge zones are noted in FIGS. 5 and 8. The discharge zone of a high-rise building is greater that that of a shorter height building. FIG. 6 shows how snow accumulates in layers 44 upon a metal roof 46. Melt water 56 flows to the bottom of the snow pack. The lower layers of the snow pack are compressed by the weight of the upper layers forming an ice layer 50 at the bottom of the snow pack. A water layer 52 forms against the metal roof 56 due to heat loss through the roof or from solar heating. The snow pack will break away in snow sheets 48 as friction resistance is broken by a combination of increasing weight and the lubricating effect of the water layer 52 between the metal roof 46 and the ice layer 50. The sliding snow sheet 48 increases spend as it hydroplanes across the metal roof 46. The sliding snow sheet 48 fractures into large chunks as it slides beyond the edge of the metal roof 46. FIG. 7 shows the continual damage caused by sliding snow. Accumulated snow 54 piles in the discharge zone and causes increased maintenance costs to remove the snow and repair the damage it causes. Additional snow sheets 48 break away from the snow pack until the entire snow pack slides off the roof. Melt water 56 and rain is directed against the building wall seeping into doors and walls. Accumulated snow 54 applies destructive force against the bottom of building walls and blocks doors and exits.

Figure 3:
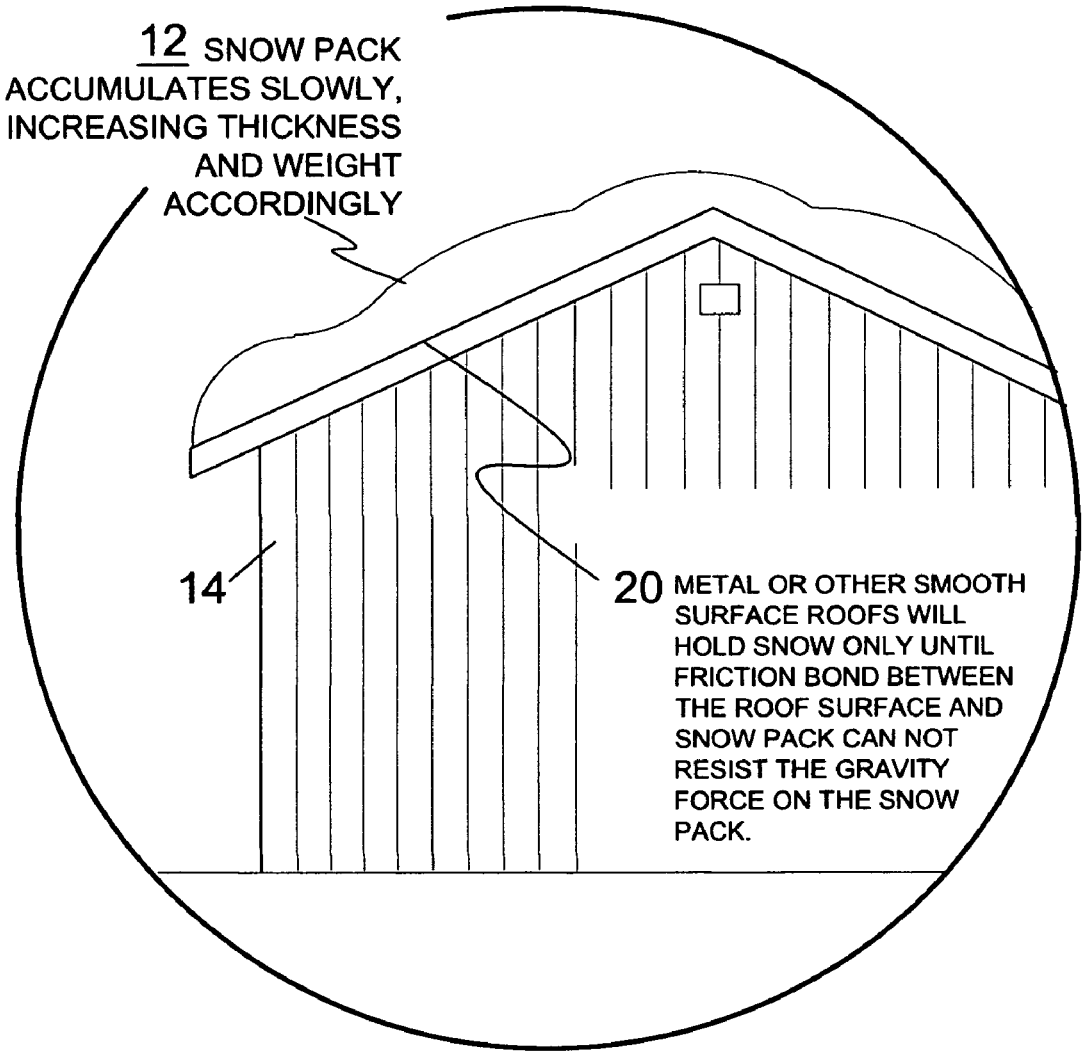
FIG. 3 is a typical view of a metal or smooth surface roof of the present invention.
Figure 4:
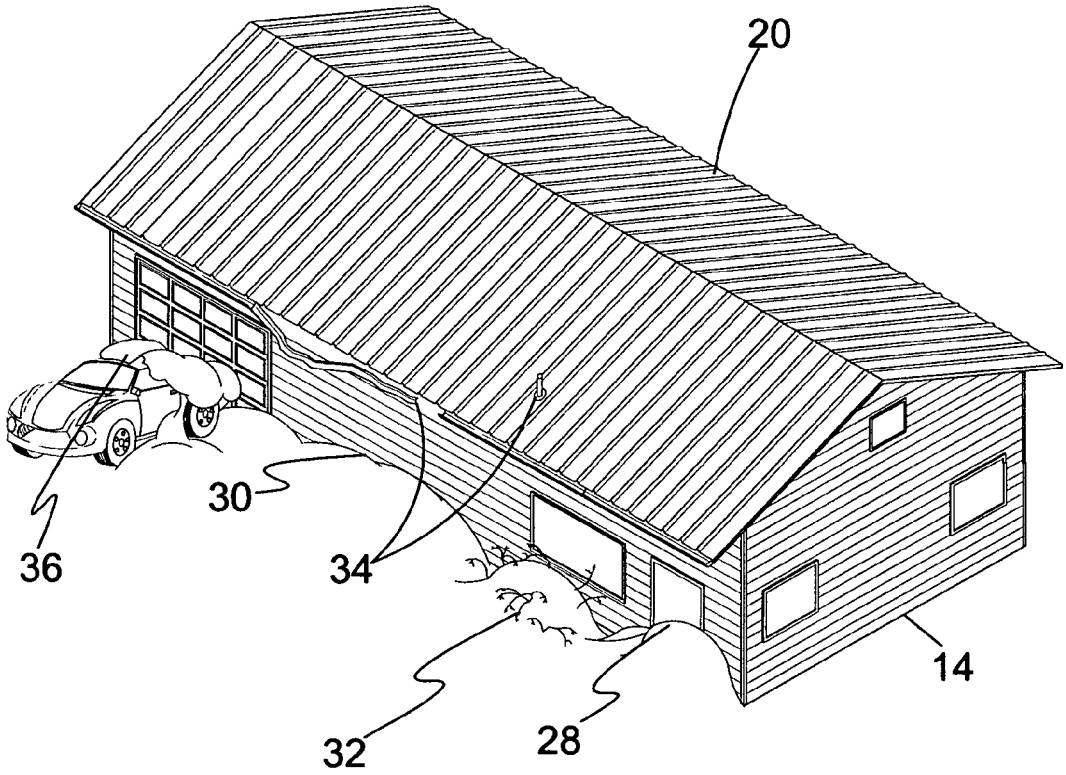
FIG. 4 is damages that could occur from snow and ice discharge from metal or smooth surface roofs.
Figure 11:
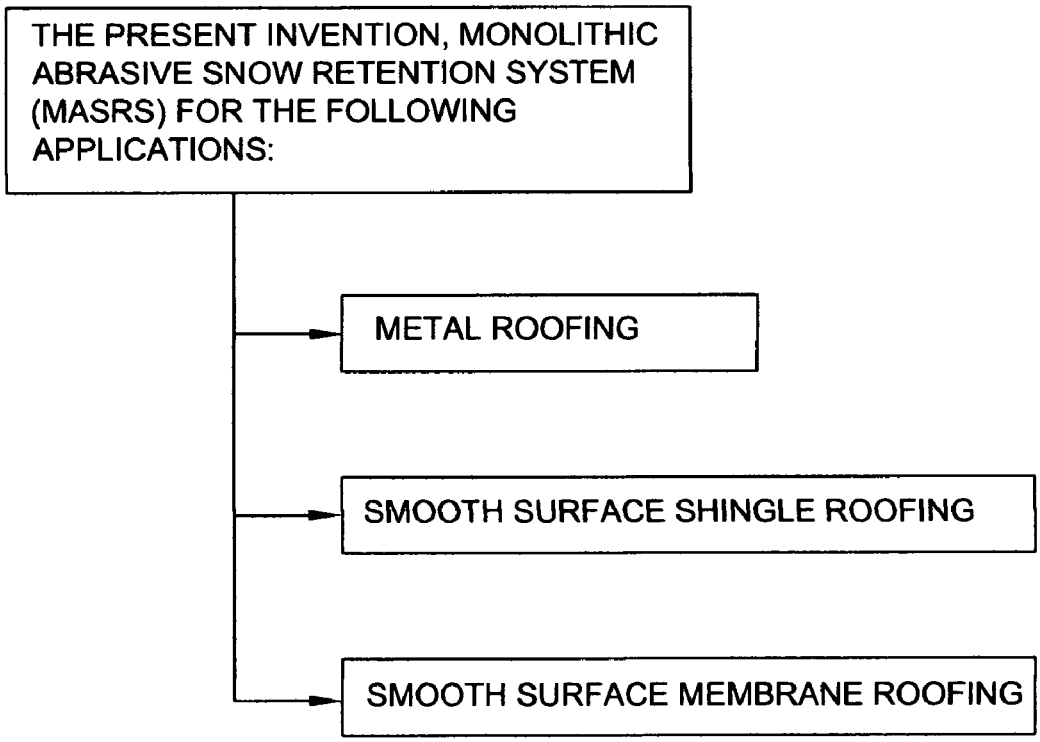
FIG. 11 is a chart of the present invention.

The present invention 10 is a snow grip roof coating system as noted in FIG. 3. The snow 12 is shown as retained on the roof 20 by snow grip coating system. The roof coating system employs an imbedded aggregate 24 for the retention of snow and ice upon the roof surface. The retention of the ice and snow 12 prevents the physical damages that may be caused by sliding ice or snow 12. The coating system may be applied to various types of roof surfaces as noted in FIG. 11. The system is not limited to these specific roof surfaces but may be employed on any roof surface where snow 12 and ice retention is desired. The system employs a base layer 22, which coats and seals the entire exposed roof surface. The base layer 22 preferably provides a liquid impermeable barrier layer on the roof 20. When the base layer 22 is a liquid impermeable layer, it provides additional service life to any existing roof. The coating system (the base layer 22 in combination with the aggregate 24) also provides the roof 20 with an additional insulation layer. The insulating value of the coating system can be enhanced by the selection of the abrasive aggregate 24 since some aggregates provide greater insulation value. The base layer 22 may employ a variety of different materials as noted in FIG. 16. The base layer 22 is not limited to the specified materials. The base layer 22 may be any material that is capable of performing the functions of the base layer 22. The base layer 22 must be able to be applied to the roof surface in a liquid state. This ensures that the aggregate 24 will be embedded into the wet surface of the base layer 22 when the aggregate 24 is spread over the base layer 22. The base layer 22 must adhere to the roof 20 surface when the base layer 22 is cured. The base layer 22 preferably will be a liquid impermeable material although it is not specifically required to function as the base layer 22. The base layer 22 must hold the aggregate 24 securely therein once the base layer 22 has cured. The base layer 22 is typically applied in a spray application 40 process but may be applied in any manner, which will provide a relatively uniform monolithic layer upon the roof surface. The base layer 22 will be applied in a thickness, which will be sufficient to retain the aggregate 24 thereon.

Figure 10:
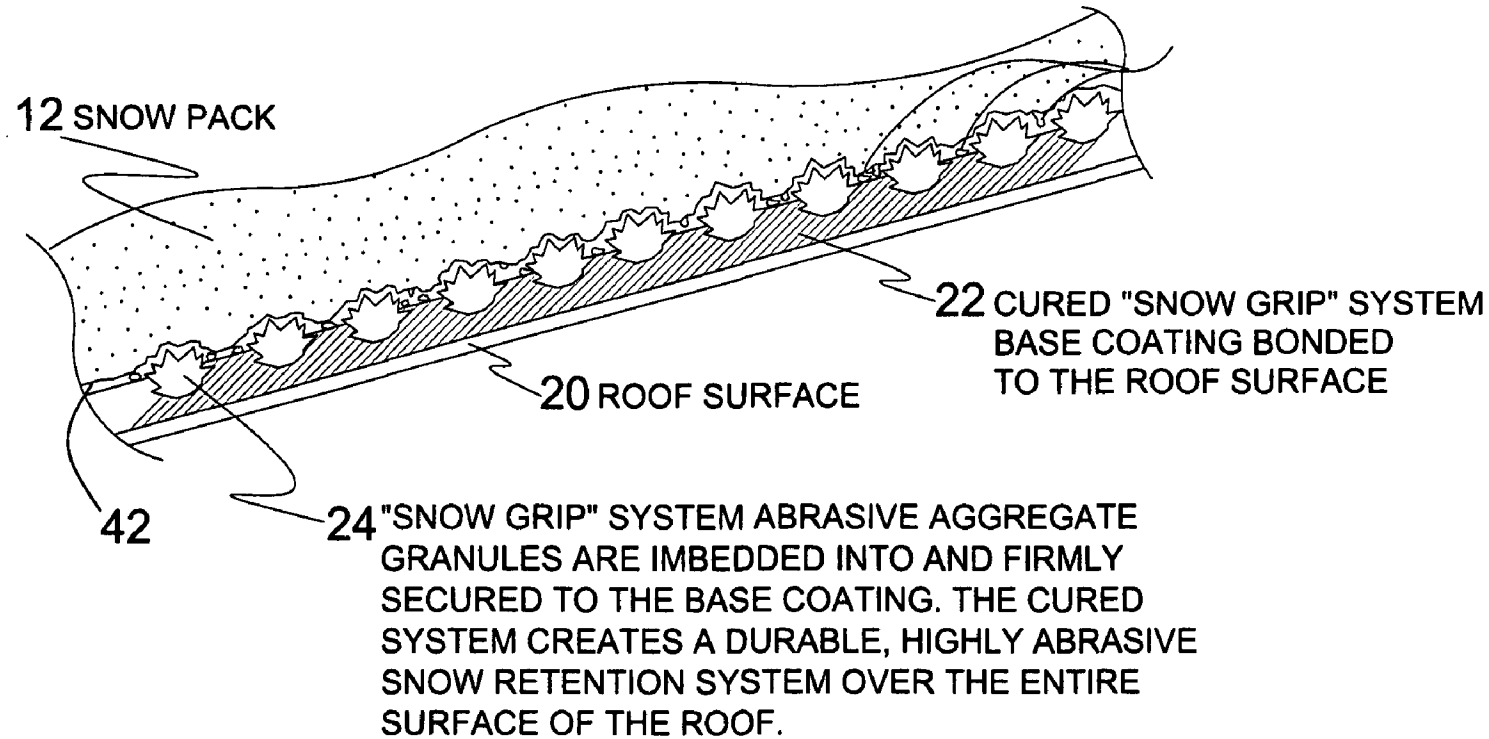
FIG. 10 is illustration of the "snow grip" system.
Figure 17:
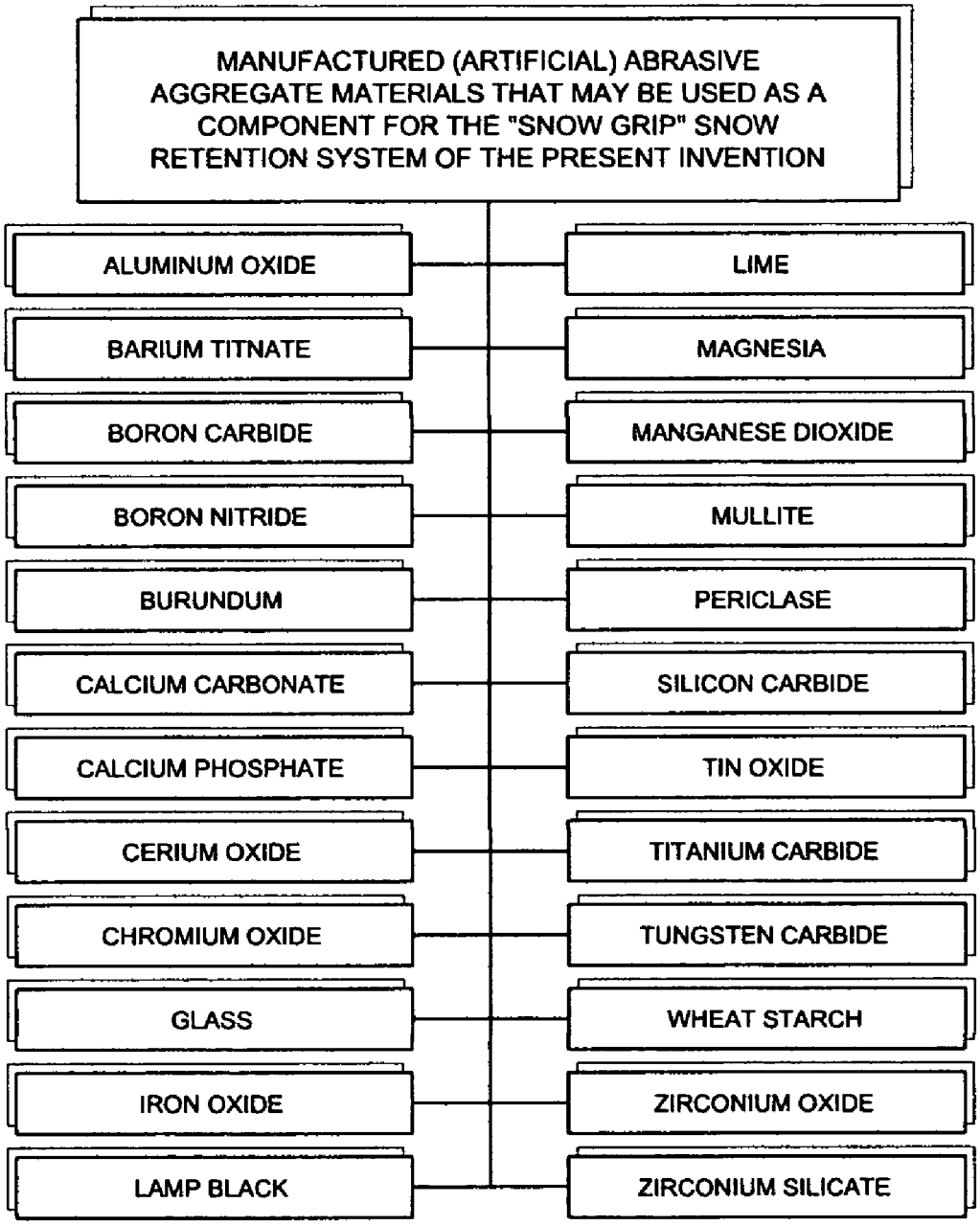
FIG. 17 is a block diagram of suitable manufactured (artificial) abrasive aggregate materials for the "snow grip" snow retention system of the present invention.
Figure 18:
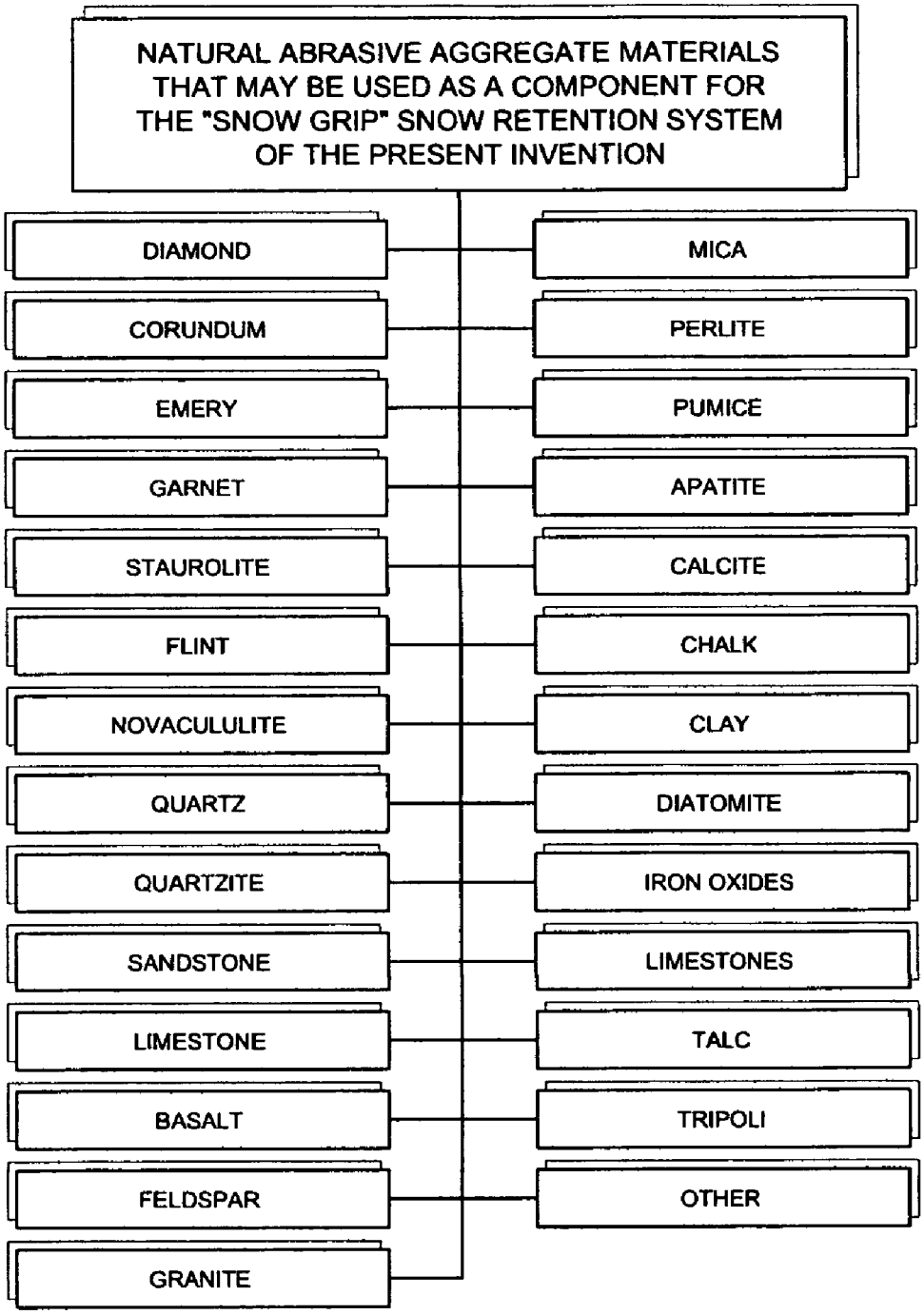
FIG. 18 is a block diagram of suitable natural abrasive aggregate materials for the "snow grip" snow retention system of the present invention.

The aggregate 24 may be a variety of abrasive materials as noted in FIGS. 17 and 18. The abrasive materials generally fall into two categories, natural and manufactured (i.e. artificial). The aggregate 24 is not limited to these specified materials. The aggregate 24 may be any abrasive material which is capable of being retained in the base layer 22 and will provide the necessary abrasive surface. The aggregate 24 will be sized in relation to the base layer 22. The aggregate 24 will be of a sufficient size so that the aggregate protrudes from the base layer 22 once the base layer 22 has cured. It is necessary to ensure that the aggregate 24 protrudes through the upper surface of the base layer 22 as seen in FIG. 10. This is commonly referred to as exposed aggregate. This is similar to an exposed aggregate sidewalk where the aggregate in the concrete protrudes thought the upper surface of the concrete to provide a non-slip surface. The aggregate 24 is exposed to ensure that the coating system has maximum snow and ice retaining capability.

The snow grip system is shown in action in FIG. 10. The base layer 22 is bonded to the roof surface. The exposed or protruding aggregate 24 retain the snow and ice since the dense and or frozen bottom surface of the snow pack forms around the aggregate particles. An air space 42 develops between the base layer 22 and the bottom surface of the snow pack, which is supported by the snow grip system. The building heat loss and solar radiation will maintain an open air space and prevent the lubricating and or hydro planning effect that promotes sliding snow and ice. The air space 42 allows melting water to drain away from the snow pack.

Figure 9:
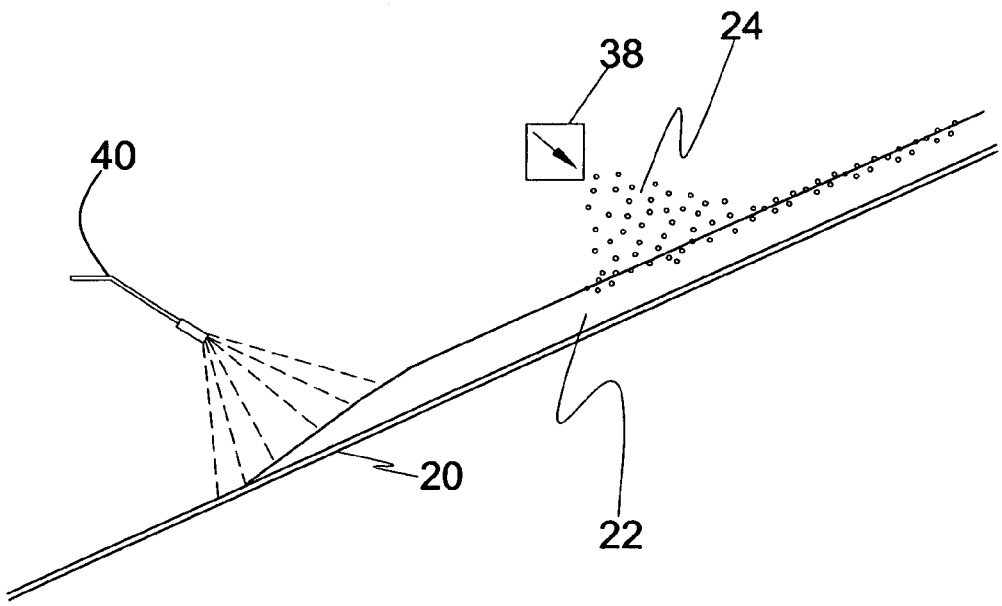
FIG. 9 is application of "snow grip" to a metal or smooth surface roof.
Figure 15:
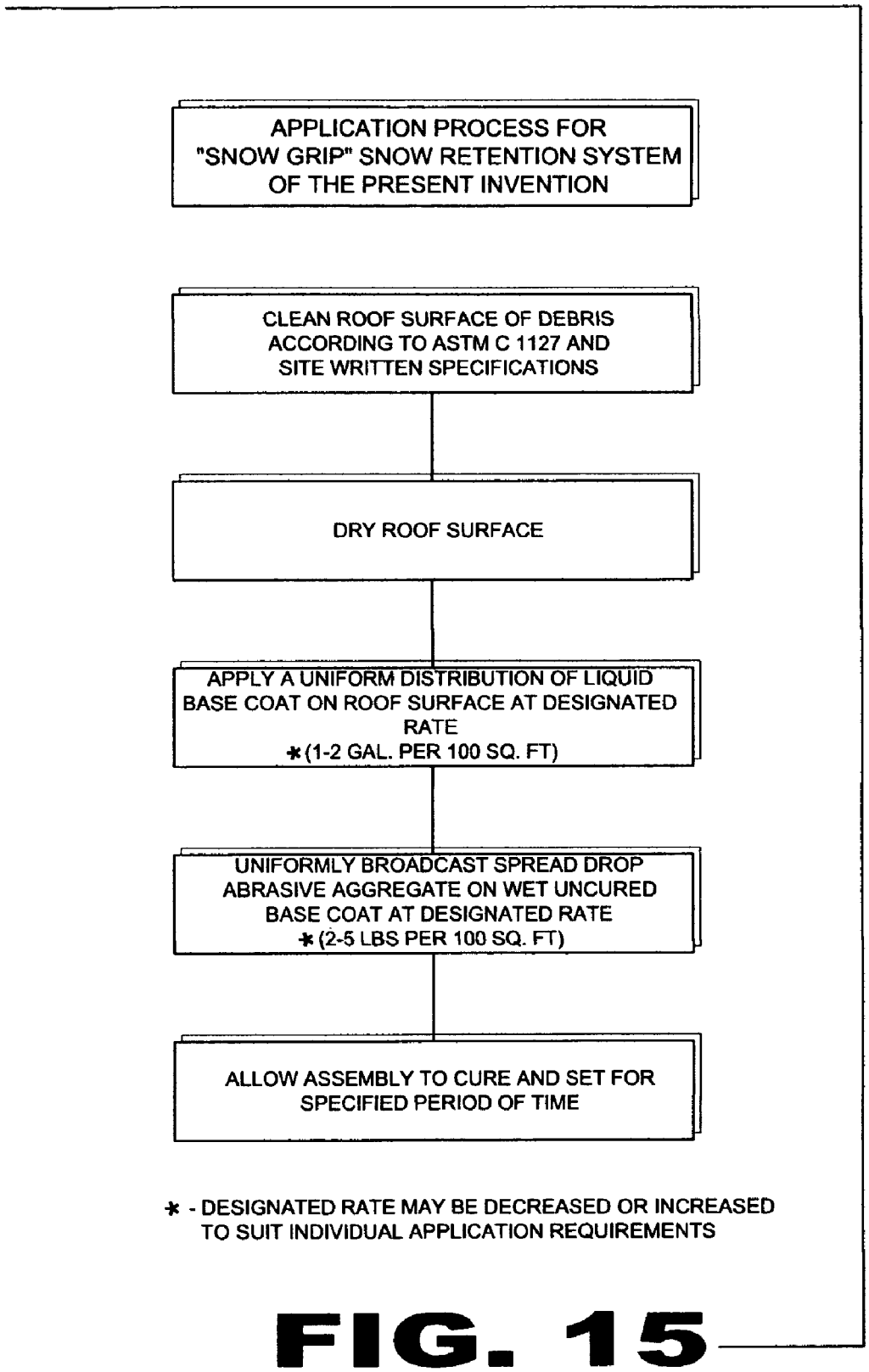
FIG. 15 is a block diagram of application process for "snow grip" snow retention system of the present invention.

The snow grip roof coating system is applied to the roof as seen in FIG. 9 as being applied to a roof 20 and in flow chart form in FIG. 15. The application process begins with cleaning the roof surface. The cleaning will preferably be performed in accordance with ASTM C 1127. The cleaning can be modified by the specific site conditions. The coating system is not limited by the above ASTM specification. The roof surface may be cleaned in any acceptable manner so long as the base layer 22 will strongly adhere to the exposed roof surface. Typically the roof is cleaned with the use of a liquid such as water. It is envisioned that the roof surface may be cleaned without the use of water or other liquids. The roof surface may be cleaned by a light blasting employing sand or soda based materials. This eliminates the need for the roof surface to dry. It is also envisioned that any holes in the roof surface will be repaired prior to the installation of the base layer to ensure a leak free roof surface. This also eliminates the need for roof repairs after the coating system has been installed. Once the exposed roof surface has been cleaned the roof is allowed to dry. The drying of the roof surface may be aided by mechanical means to remove excess moisture and or debris from the roof surface. Once it has been determined that the entire roof surface is dry, the base layer 22 is applied. Once the base layer has been applied the abrasive aggregate 24 is broadcast or spread over the base layer 22 while the base layer 22 is still wet. The aggregate 24 is spread over the base layer at a designated rate (lbs per SQ ft), which is preferably 2-5 lbs per sq foot but may be provided at higher or lower rates of application. The aggregate may be applied by a broadcast application 38 process or any other suitable application process. The spread rate may be varied depending on the slope of the roof and the material of which the roof is made. The base layer 22 may be provided with a colorant to change the color or to enhance the appearance of the coated roof surface. Once the aggregate 24 has been spread over the base layer 22, the base layer 22 is allowed to cure or dry. Once the base layer 22 is cured, the base layer 22 is secured to the roof surface and thereby secures the aggregate 24 to the roof surface by the virtue that the aggregate is bound in the base layer 24.

Figure 12:
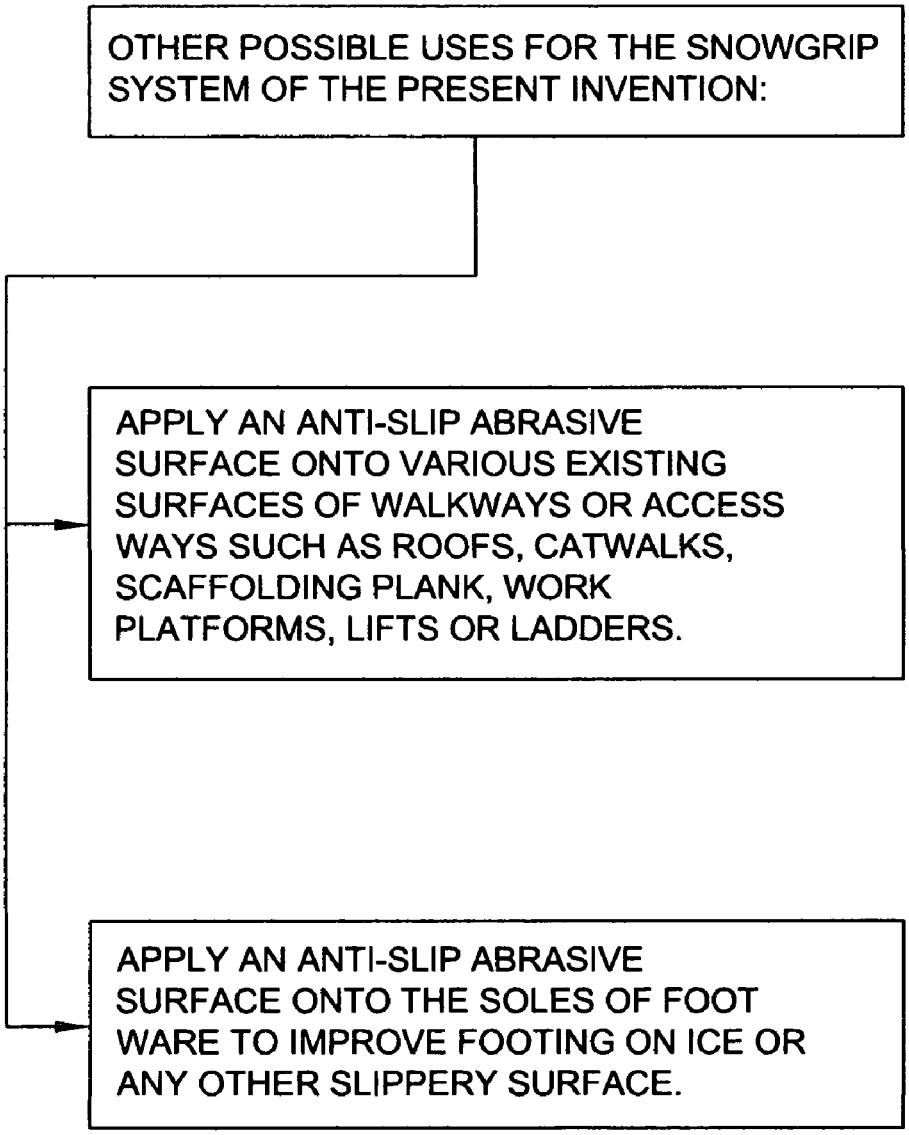
FIG. 12 is a chart of the present invention.
Figure 13:
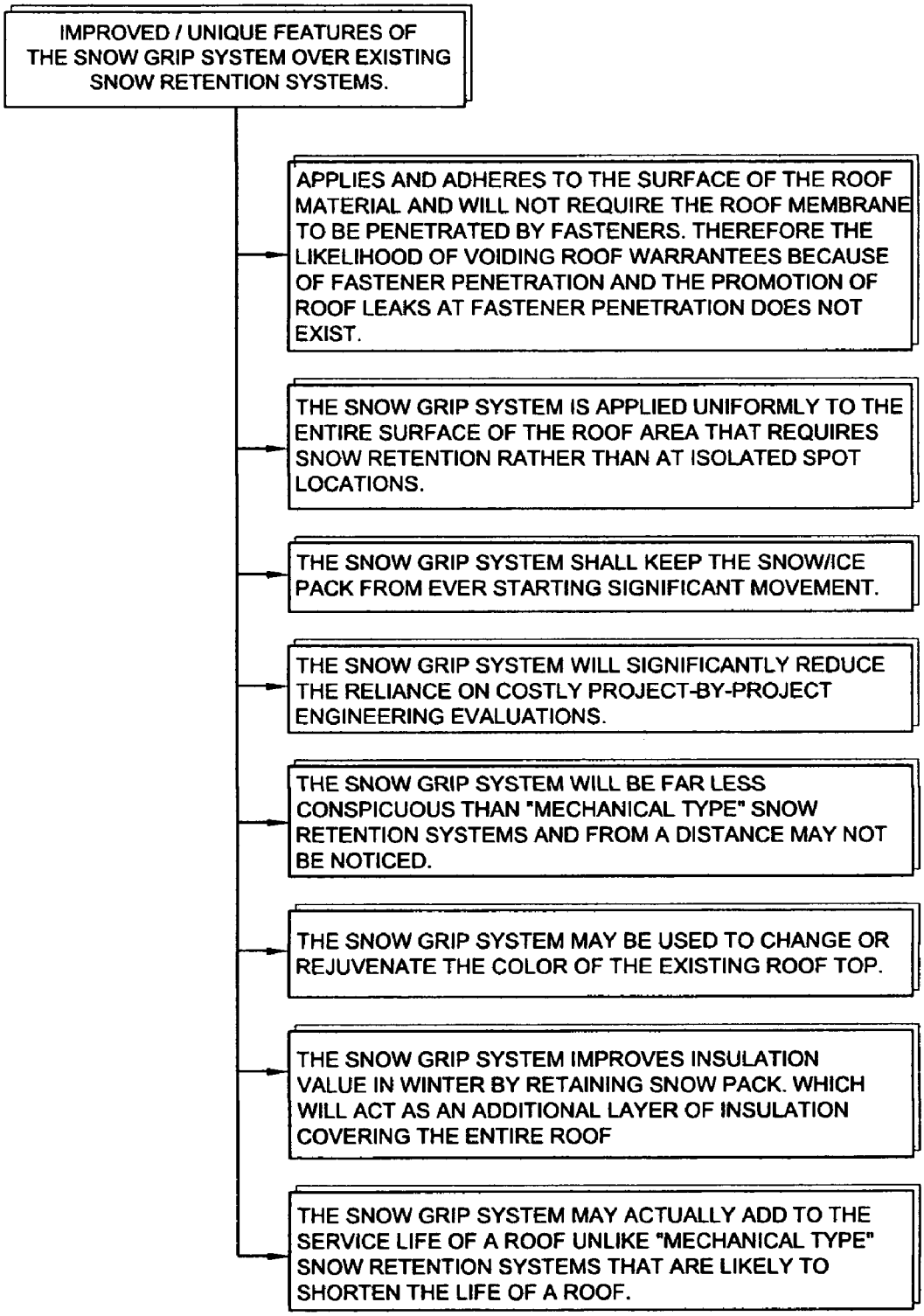
FIG. 13 is a chart of the present invention.

The snow grip system is not limited to being used on existing roof surfaces that are in place on a building or the like. The snow grip system may be installed on roof stock material(s) prior to their application on a building roof surface or the like. The roof stock materials may include but are not limited to shingles, shakes, rolled roofing, sheet roofing, or any other roof material that has an upper surface that is capable of receiving the snow grip system prior to the stock material being installed on the intended roof surface. The upper surface of the stock material that will remain at least partially exposed (i.e. visible) after the stock material has been installed on the intended roof surface. The upper surface may not be completely exposed due to overlapping between adjacent pieces of stock material. The roof stock material has a down or facing surface that is opposite to the exposed surface and faces the building roof surface once the stock material has been installed. The down or facing surface will typically be hidden once the stock material has been installed on the building roof surface. The down or facing surface may be partially visible where the stock material may overhang the building roof surface. This occurs with stock material in the form of shingles at the edges of a building roof. The snow grip system may also be employed in other areas as an anti-slip coating as noted in FIG. 12. The improved and/or unique features of the snow grip system are noted in FIG. 13.

I claim:

1. A method of applying a coating to a roof, the method comprising:

providing a roof surface, cleaning the exposed roof surface, providing a base material for application to the roof surface to form a base layer upon the roof, applying the base material over the roof surface to form the base layer, providing an aggregate material for application over the base layer, applying the aggregate material over the base layer while the base layer is in a liquid state; and allowing the base layer to cure.

2. The method of claim 1, wherein the material that forms the base layer is impervious to liquids.

3. The method of claim 2, wherein the entire roof surface is coated with the base layer.

4. The method of claim 3, wherein the aggregate is spread over the base layer at a rate of 2-5 pounds per 100 square feet of the base layer.

5. The method of claim 4, wherein the base layer is applied over the roof surface at a rate of 1-2 gallons per 100 square feet of roof surface.

6. The method of claim 1, wherein the material of the base layer is selected from the group consisting of liquid rubber, acrylic, polyurethane foam, polyvinyl chloride, and latex.

7. The method of claim 1, wherein the aggregate is a material selected from the group consisting of aluminum oxide, barium titnate, boron carbide, boron nitride, burundum, calcium carbonate, calcium phosphate, cerium oxide, chromium oxide, glass, iron oxide, lamp black, lime, magnesia, manganese dioxide, mullite, periclase, silicon carbide, tin oxide, titanium carbide, tungsten carbide, wheat starch, zirconium oxide, and zirconium silicate.

8. The method of claim 1, wherein the aggregate is a material selected from the group consisting of diamond, corundum, emery, garnet, staurolite, flint, novacululite, quartz, quartzite, sandstone, limestone, basalt, feldspar, granite, mica, perlite, pumice, apatite, calcite, chalk, clay, diatomite, iron oxides, lime stones, talc, and Tripoli.

9. The method of claim 1, wherein cleaning is performed with a liquid.

10. The method of claim 1, wherein the cleaning is performed without the use of a liquid.

11. The method of claim 10, wherein the cleaning is performed by a blasting process using a dry sand or soda based material.

12. The method of claim 1, wherein the roof surface is secured to a building prior to the application of the base layer.

13. The method of claim 1, wherein the aggregate is sized so that the aggregate protrudes through an upper surface of the base layer once the base layer has cured.

14. A method of applying a coating to a roof, the method comprising:

providing a roof surface, cleaning the exposed roof surface, providing a base material for application to the roof surface to form a base layer upon the roof, applying the base material over the entire roof surface to form the base layer, providing an aggregate material for application over the base layer, applying the aggregate material over the base layer while the base layer is in a liquid state; and allowing the base layer to cure.

15. The method of claim 14, wherein the material that forms the base layer is impervious to liquids.

16. The method of claim 15, wherein the entire roof surface is coated with the base layer.

17. The method of claim 16, wherein the aggregate is spread over the base layer at a rate of 2-5 pounds per 100 square feet of the base layer.

18. The method of claim 17, wherein the base layer is applied over the roof surface at a rate of 1-2 gallons per 100 square feet of roof surface.

19. The method of claim 15, wherein the roof surface is secured to a building prior to the application of the base layer.

20. The method of claim 14, wherein the material of the base layer is selected from the group consisting of liquid rubber, acrylic, polyurethane foam, polyvinyl chloride, and latex.

21. The method of claim 14, wherein the aggregate is a material selected from the group consisting of aluminum oxide, barium titnate, boron carbide, boron nitride, burundum, calcium carbonate, calcium phosphate, cerium oxide, chromium oxide, glass, iron oxide, lamp black, lime, magnesia, manganese dioxide, mullite, periclase, silicon carbide, tin oxide, titanium carbide, tungsten carbide, wheat starch, zirconium oxide, and zirconium silicate.

22. The method of claim 14, wherein the aggregate is a material selected from the group consisting of diamond, corundum, emery, garnet, staurolite, flint, novacululite, quartz, quartzite, sandstone, limestone, basalt, feldspar, granite, mica, perlite, pumice, apatite, calcite, chalk, clay, diatomite, iron oxides, lime stones, talc, and Tripoli.

23. The method of claim 14, wherein cleaning is performed with a liquid.

24. The method of claim 14, wherein the cleaning is performed without the use of a liquid.

25. The method of claim 24, wherein the cleaning is performed by a blasting process using a dry sand or soda based material.

26. The method of claim 14, wherein the aggregate is sized so that the aggregate protrudes through an upper surface of the base layer once the base layer has cured.

27. A method of applying a coating to a stock material where the stock material is intended for application on a roof surface, the method comprising:

providing a stock material suitable for application on a roof surface wherein the stock material has an upper surface that remains at least partially exposed after the stock material has been installed on the roof surface, providing a base material for application to the stock material to form a base layer upon the stock material, applying the base material over the exposed surface of stock material to form the base layer where the application takes place prior to the installation of the stock material, providing an aggregate material for application over the base layer, applying the aggregate material over the base layer while the base layer is in a liquid state; and allowing the base layer to cure.

28. The method of claim 27, wherein the material that forms the base layer is impervious to liquids.

29. The method of claim 28, wherein the entire upper surface of the stock material is coated with the base layer.

30. The method of claim 28, wherein only a portion of the upper surface of the stock material is coated with the base layer and a portion of the upper surface of the stock material remains uncoated.

31. The method of claim 30, wherein the aggregate is spread over the base layer at a rate of 2-5 pounds per 100 square feet of base layer.

32. The method of claim 30, where the base layer is applied over the upper surface of the stock material at a rate of 1-2 gallons per 100 square feet of the covered portion of the upper surface.

33. The method of claim 27, wherein the material of the base layer is selected from the group consisting of liquid rubber, acrylic, polyurethane foam, polyvinyl chloride, and latex.

34. The method of claim 27, wherein the aggregate is a material selected from the group consisting of aluminum oxide, barium titnate, boron carbide, boron nitride, burundum, calcium carbonate, calcium phosphate, cerium oxide, chromium oxide, glass, iron oxide, lamp black, lime, magnesia, manganese dioxide, mullite, periclase, silicon carbide, tin oxide, titanium carbide, tungsten carbide, wheat starch, zirconium oxide, and zirconium silicate.

35. The method of claim 27, wherein the aggregate is a material selected from the group consisting of diamond, corundum, emery, garnet, staurolite, flint, novacululite, quartz, quartzite, sandstone, limestone, basalt, feldspar, granite, mica, perlite, pumice, apatite, calcite, chalk, clay, diatomite, iron oxides, lime stones, talc, and Tripoli.

36. The method of claim 27, wherein the upper surface of the stock material is cleaned prior to the application of the base layer.

37. The method of claim 27, wherein cleaning is performed with a liquid.

38. The method of claim 27, wherein the cleaning is performed without the use of a liquid.

39. The method of claim 38, wherein the cleaning is performed by a blasting process using a dry sand or soda based material.

40. The method of claim 39, wherein the aggregate is spread over the base layer at a rate of 2-5 pounds per 100 square feet of base layer.

41. The method of claim 40, wherein the base layer is applied over the upper surface of the stock material at a rate of 1-2 gallons per 100 square feet of upper surface.

42. The method of claim 27, wherein the aggregate is sized so that the aggregate protrudes through an upper surface of the base layer once the base layer has cured.

43. A method of applying a coating to a roof, the method comprising:

providing a roof surface, cleaning the exposed roof surface, providing a base material for application to the roof surface to form a base layer upon the roof, applying the base material over the roof surface to form the base layer where the base material is applied at a rate of 1-2 gallons per 100 square feet of roof surface, providing a granular aggregate material for application over the base layer where the granular aggregate is applied at a rate of 2-5 pounds per 100 square feet of the base layer, applying the granular aggregate material over the base layer while the base layer is in a liquid state, allowing the base layer to cure; and wherein the granular aggregate material protrudes through an upper surface of the base layer once the base layer has cured.

* * * * *